US012173905B2

(12) United States Patent
Lei

(10) Patent No.: US 12,173,905 B2
(45) Date of Patent: Dec. 24, 2024

(54) PARALLEL DOUBLE FAN SYSTEM AND A RANGE HOOD THEREOF

(71) Applicant: NINGBO FOTILE KITCHEN WARE CO., LTD., Zhejiang (CN)

(72) Inventor: Gai Lei, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 407 days.

(21) Appl. No.: 17/775,891

(22) PCT Filed: Nov. 5, 2020

(86) PCT No.: PCT/CN2020/126720

§ 371 (c)(1),
(2) Date: May 11, 2022

(87) PCT Pub. No.: WO2022/088222

PCT Pub. Date: May 5, 2022

(65) Prior Publication Data

US 2022/0381447 A1 Dec. 1, 2022

(30) Foreign Application Priority Data

Nov. 2, 2020 (CN) ..... 202011204184.5

(51) Int. Cl.
*F24C 15/20* (2006.01)

(52) U.S. Cl.
CPC ..... *F24C 15/20* (2013.01)

(58) Field of Classification Search
CPC ..... F24C 15/20; F04D 29/4246; F04D 29/42; F04D 29/4226; F04D 25/166
USPC ..... 126/299 R
See application file for complete search history.

(56) References Cited

U.S. PATENT DOCUMENTS

| | | | | |
|---|---|---|---|---|
| 5,281,092 | A | 1/1994 | Sullivan | |
| 11,835,060 | B2 * | 12/2023 | Jiang | F24C 15/20 |

FOREIGN PATENT DOCUMENTS

| | | |
|---|---|---|
| CH | 604014 | 8/1978 |
| CN | 2679405 | 2/2005 |
| CN | 102242944 | 11/2011 |
| CN | 104005996 | 8/2014 |
| CN | 104454648 | 3/2015 |
| CN | 104564828 | 4/2015 |
| CN | 105736469 | 7/2016 |
| CN | 210164688 | 3/2020 |
| JP | 4123228 | 7/2008 |
| JP | 2015102046 | 6/2015 |

OTHER PUBLICATIONS

"International Search Report (Form PCT/ISA/210) of PCT/CN2020/126720," mailed on Aug. 2, 2021, pp. 1-5.

* cited by examiner

*Primary Examiner* — Ko-Wei Lin
(74) *Attorney, Agent, or Firm* — JCIPRNET

(57) ABSTRACT

A parallel double fan system, includes two fan systems disposed in parallel; wherein each fan system includes a volute having a front cover, a rear cover and an annular wall; the annular wall has a volute tongue; the rear cover has a first air outlet located above the corresponding volute tongue, two first air outlets in the two fan systems are communicated with each other. A range hood equipped with the parallel double fan system is also disclosed.

11 Claims, 12 Drawing Sheets

PARALLEL DOUBLE FAN SYSTEM AND A RANGE HOOD THEREOF

CROSS-REFERENCE TO RELATED APPLICATION

This application is a 371 of international application of PCT application serial no. PCT/CN2020/126720, filed on Nov. 5, 2020, which claims the priority benefit of China application no. 202011204184.5, filed on Nov. 2, 2020. The entirety of each of the above mentioned patent applications is hereby incorporated by reference herein and made a part of this specification.

TECHNICAL FIELD OF THE INVENTION

The present invention relates to an oil fume purification device, and in particular to a parallel double fan system and a range hood thereof.

BACKGROUND OF THE INVENTION

Range hoods have become one kind of indispensable kitchen appliances in modern families. Range hoods operate on the principle of fluid dynamics, suck and exhaust oil fume through centrifugal fans mounted inside the range hoods and filter some oil particles through filter screens. The centrifugal fan comprises a volute, an impeller mounted in the volute and a motor for driving the impeller to rotate. When the impeller rotates, a negative-pressure suction force is generated in the center of the fan, so that oil fume under the range hood is sucked into the fan, accelerated by the fan and then collected by the volute and guided to the outside.

At present, the range hood market has a plurality of horizontal (thin) range hoods. The range hoods are mainly characterized in that the fan system is disposed horizontally, the centrifugal fan system is generally used and the rotating shaft of the motor is vertical to the table of the cooker. For example, a Chinese Utility Model Patent CN207006315U (patent NO.: 201720917014.9) disclosed an ultra-thin ceiling-mounted range hood, at least comprising a housing and an air supply component, wherein the air supply component comprises a fan volute, a motor matched with the fan volute and an impeller; the fan volute comprises a front cover having an air inlet formed thereon and an middle annular wall; the middle annular wall vertically connects the front cover by using a continuous smoothly-transited curved surface to form an inner flow passage opened upward and an air supply port.

At described above, most of the existing thin range hoods adopt a single-fan system, so that the overall fume trapping range is relatively small. In the cooking state of the kitchen, cooking fume in the kitchen is relatively dispersed. However, the cooker is mostly a double-burner cooker or a multi-burner cooker, so that the fuming region of the kitchen is not within the air inlet region of the range hood, resulting in fume escape which is manifested by poor fume suction effect. In addition, the whole range hood is high in noise.

In order to increase the fume trapping range and adapt to double-burner or multi-burner cookers, a common method is to use a parallel double fan system. However, the existing parallel double fan systems are commonly used in ceiling-mounted or side-mounted range hoods. These types of range hoods have a relatively single air outlet form and a simple flow field. If the parallel double fan system is directly used in thin range hoods, the requirements for air discharge are often difficultly satisfied. Therefore, the parallel double fan system needs to be further improved.

SUMMARY OF THE INVENTION

It is a first object of the present invention to provide a parallel double fan system, which can reduce the flow loss and ensure the flow demand.

It is a second object of the present invention to provide a range hood equipped with the system described above.

For achieving the first object, the parallel double fan system comprises two fan systems disposed in parallel; wherein each fan system comprises a volute having a front cover, a rear cover and an annular wall connected between the front cover and the rear cover; wherein, the annular wall has a volute tongue; the front cover has an air inlet;

characterized in that the rear cover has a first air outlet located above the corresponding volute tongue, two first air outlets in the two fan systems are communicated with each other;

the intersection of the annular wall and the rear cover is defined as a first profile line of the volute, the first profile line comprises a first line segment, a second line segment, a third line segment, a fourth line segment, a fifth line segment and a sixth segment that are smoothly connected in turn; the starting point of the first line segment and the ending point of the sixth line segment are respectively the starting point and ending point of the first profile line, and the ending point of the second line segment corresponds to the ending point of the volute tongue in the first profile line; the third line segment is a spiral line with an equal spiral angle; and the fourth line segment is a spiral line whose spiral angle gradually decreases from the connection point between the third line segment and the fourth line segment to the connection point between the fourth line segment and the fifth line segment.

In order to facilitate an air flow to collide with the first air outlet or the air outlet mechanism disposed at the first air outlet to reduce aerodynamic noise, preferably, an impeller is disposed inside the volute, and the following coordinate system of the first profile line is established: an intersection point that an axis of the impeller passing through the plane of the first profile line is defined as an origin of coordinates, horizontal coordinate axis is defined as an X-axis, and vertical coordinate axis is defined as a Y-axis; the first line segment and the sixth line segment are located in a first quadrant of the coordinate system; and the first line segment is a straight line segment parallel to the Y-axis.

In order to avoid the noise caused by the collision of two air flows converged in the two volutes, preferably, the sixth line segment is a straight line segment parallel to the Y-axis.

In order to increase the pressure of the air flow near the first air outlet and ensure the flow, preferably, the fifth line segment is smoothly connected between the fourth line segment and the sixth line segment, the X-coordinates of the fourth line segment are less than the X-coordinates of the sixth line segment; the ending point of the fifth line segment corresponds to the intersection point of the position of the annular wall near the rear cover and the first air outlet; and the first air outlet extends from the intersection point to the starting point and ending point of the first profile line.

Preferably, according to the law of movement of the cylindrical turbulent flow field, the fifth line segment is a Bezier curve.

In order to realize relative stable movement of the air flow in the internal space of the volute, preferably, an impeller is disposed inside the volute; the intersection of the annular wall and the front cover is defined as a second profile line of the volute, the second profile line comprises a first line segment, a third line segment, a fourth line segment, a fifth line segment and a sixth line segment that are the same as those of the first profile line; a seventh line segment and an eighth line segment are smoothly connected between the first line segment and the third line segment in turn; the ending point of the second line segment in the first profile line corresponds to the ending point of the eighth line segment in the second profile line, and the ending point of the seventh line segment corresponds to the ending point of the volute tongue in the second profile line.

In order to relieve the backflow at the volute tongue, reduce the noise produced by backflow and facilitate the guidance of the air flow to the first air outlet, preferably, the annular wall comprises a first air outlet sidewall, an annular wall main portion, a transition wall, a second air outlet sidewall and an extension wall; the profile line of the first air outlet sidewall corresponds to the first line segment; the profile line at a side of the annular wall main portion intersected with the rear cover corresponds to the third line segment and the fourth line segment; the profile line at a side of the annular wall main portion intersected with the front cover corresponds to the eighth line segment, the third line segment and the fourth line segment; the profile line of the transition wall corresponds to the fifth line segment; the profile line of the second air outlet sidewall corresponds to the sixth line segment; the extension wall and the volute tongue are connected between the first air outlet sidewall and the annular wall main portion, the profile line at a side of the extension wall and the volute tongue intersected with the rear cover is the second line segment, and the profile line at a side of the extension wall and the volute tongue intersected with the front cover is the seventh line segment, so that the volute tongue and the extension wall are an inclined flow guide curved surface on a side facing the volute as a whole.

Preferably, in order to better reduce the backflow, the profile lines of the volute tongue and the extension wall at the intersections with the front cover and the rear cover are double-spine curves. More preferably, the second line segment of the first profile line is a Bezier curve, and the line segment formed by the seventh line segment and the eighth line segment of the second profile line is also a Bezier curve.

For achieving the second object, the range hood equipped with the parallel double fan system comprises a housing and the fan system disposed inside the housing; characterized in that the front cover is located below the rear cover, and the air inlet faces downward and the first air outlets face upward.

In order to adapt to different mounting environments, preferably, the annular wall has a first end and a second end; the starting point of the first line segment is located at the first end of the annular wall, and the ending point of the sixth line segment is located at the second end of the annular wall; the first end and the second end of the annular wall, the front cover and the rear cover form a second air outlet; and the first air outlet and the second air outlet selectively communicates the fan systems with the outside.

In order to avoid the disorder of the air flow, orderly guide the air flow to the first air outlet and reduce the start noise, preferably, a flow guide device for guiding the air flow to the first air outlet is disposed at the second air outlet.

Compared with the prior art, the present invention has the following advantages. Since the profile line of the volute is a multi-segment fitted curve, a complex flow field where air is discharged from the top of the parallel double fan system. By adopting a double-spiral line design for the curve section of the profile line of the volute, two air flows in the parallel double fan system are converged into one air flow for discharging. At the first spiral line, an equiangular spiral line is adopted to increase pressure and velocity. After the pressure is increased to a certain extent, the velocity is increased slowly, so that at the vicinity of the air outlet, the air discharge velocity is not high while the pressure is high. When two air flows are converged, the air flow can be guided to flow to the air outlet due to the difference in pressure at the air outlet, and the velocity is not too high to increase noise. Since the two straight line segments corresponding to the air outlet are vertical lines, the air flow can be guided vertically for discharging, thereby avoiding the presence of an included angle between air flows in the air discharge velocity and the vertical direction from resulting in the collision of two air flows and the production of additional noise. The volute tongue is an inclined structure which is a curved surface design formed by a double-spline curve, the structure in which air is discharged from the top is adapted, the air flow is stabilized, and the flow loss and aerodynamic noise caused by backflow are reduced.

DETAILED DESCRIPTION OF THE EMBODIMENTS

Figure 1:
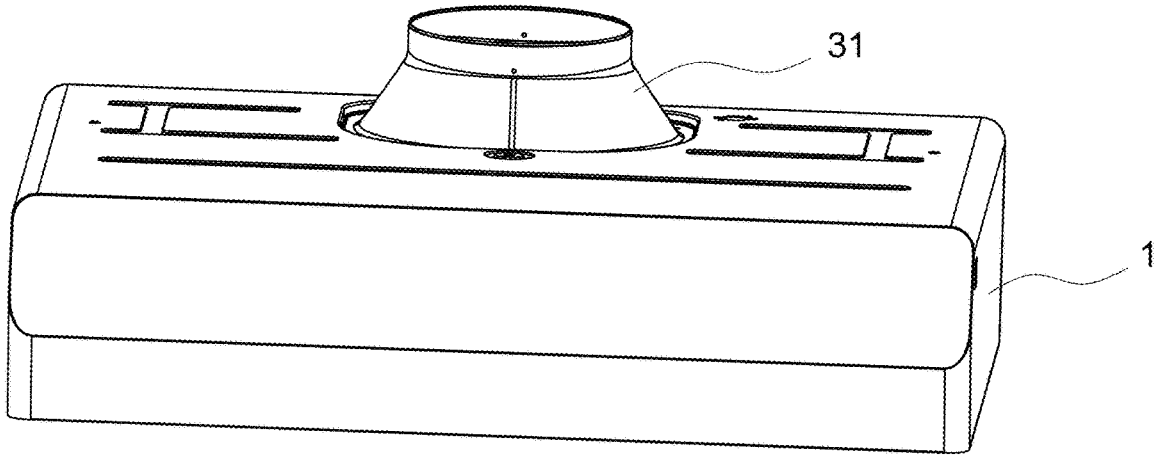
FIG. 1 is a perspective view of a range hood in a state where the air is discharged from the top according to an embodiment of the present invention.
Figure 2:
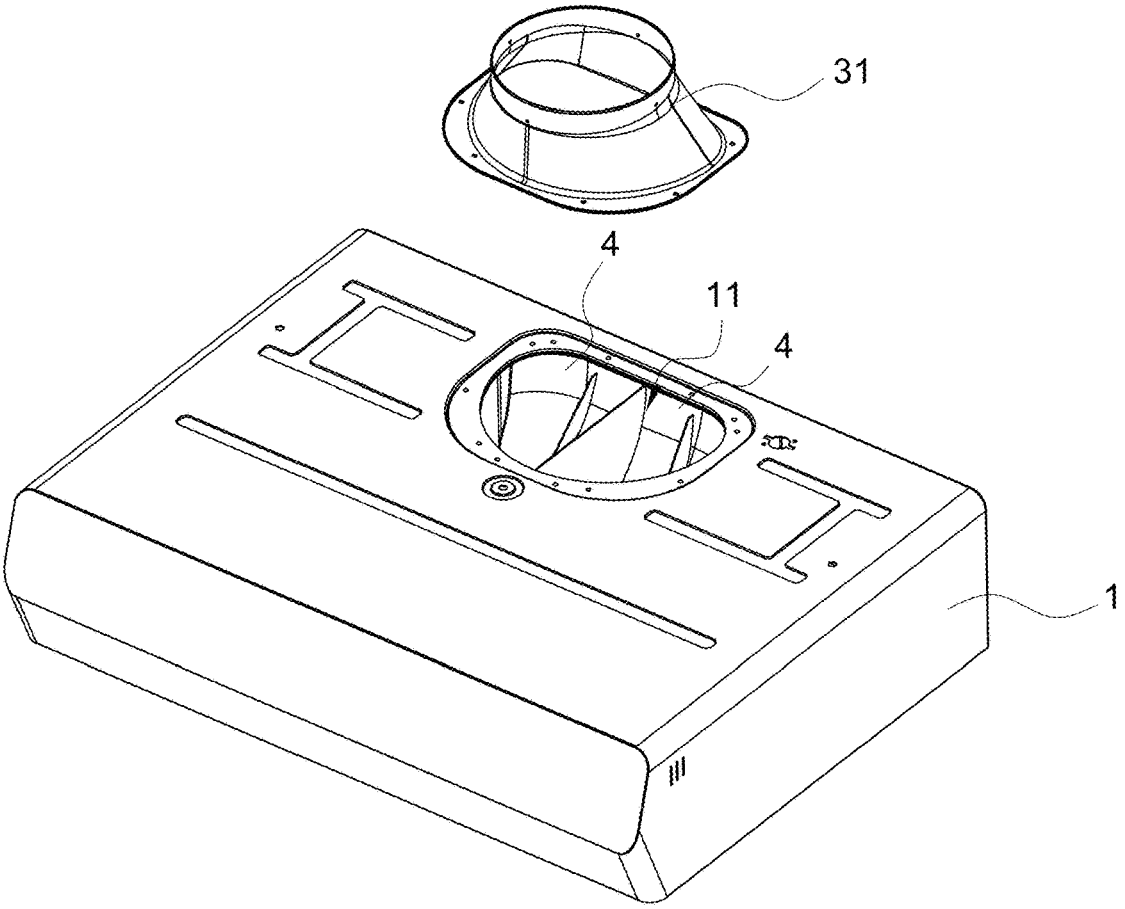
FIG. 2 is an exploded view of the range hood of FIG. 1.
Figure 3:
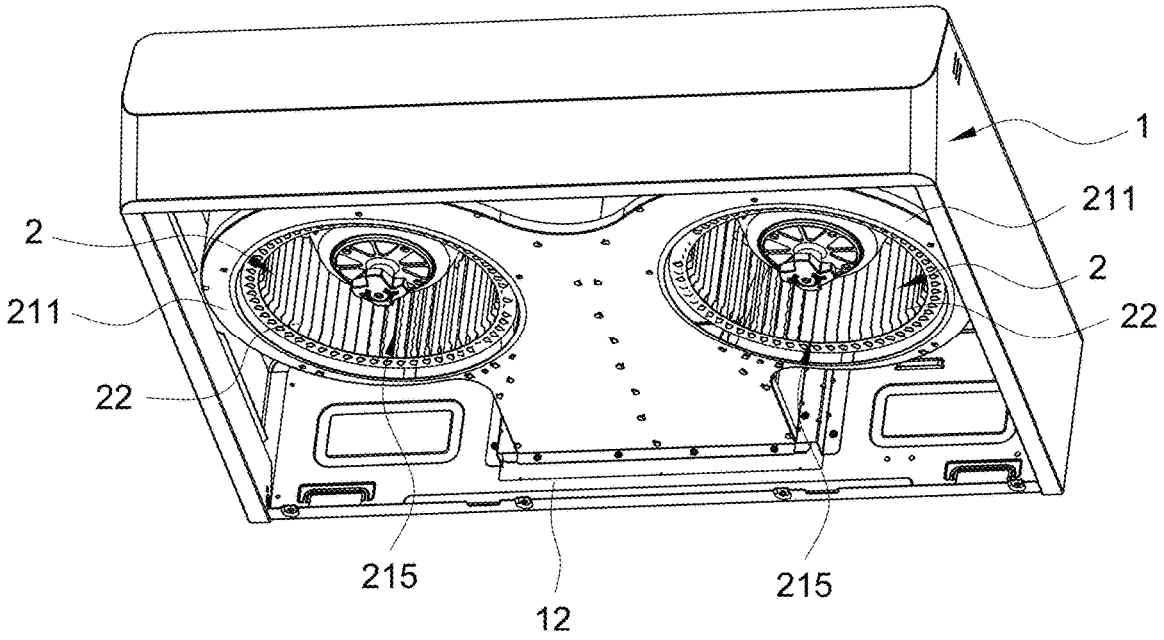
FIG. 3 is a perspective view of the range hood of FIG. 1 viewed from the bottom.

The embodiments of the present invention will be described below in detail. The examples of these embodiments have been illustrated in the accompanying drawings throughout which like or similar reference numerals indicate like or similar elements or elements having like or similar functions.

It is to be noted that, in the description of this embodiment, orientations or location relationships indicated by terms such as "center", "lengthways", "transverse", "length", "width", "thickness", "up", "down", "front", "rear", "left", "right", "vertical", "horizontal", "top", "bottom", "inside", "outside", "clockwise", "anticlockwise", "axial", "radial", "circumference" are the orientations and location relationships illustrated on the basis of the accompany drawings. Such terms are used just for ease of describing the present invention and simplifying the description, and it is not indicated or implied that the stated device or element must have a specific orientation or must be constructed and operated in the specific orientation, the embodiment of the present invention can be set in different directions, and shall not be interpreted as any limitation to the present invention. For example, "up" and "down" are not always limited to directions opposite or consistent with the direction of gravity. In addition, features that qualify as "first" or "second" may comprise, explicitly or implicitly, one or more of these features.

FIGS. 1-9 show a preferred embodiment of a range hood equipped with a parallel double fan system of the present invention. The range hood is a horizontal range hood, which comprises a housing 1 and two fan systems 2 disposed in parallel inside the housing 1.

The fan systems 2 are centrifugal fans, and each comprises a volute 21, an impeller 22 disposed inside the volute 21 and a motor 23 for driving the impeller 22 to rotate. Two fan systems 2 are disposed in parallel. In the present invention, the parallel connection of two fan systems 2 means that the axes of the two fan systems 2 are parallel to each other and the two fan systems are located at the same position in the flow path of oil fume.

Each volute 21 comprises a front cover 211, a rear cover 212 and an annular wall 213 connected between the front cover 211 and the rear cover 212. The annular wall 213 has a volute tongue 214. The front cover 211 is located below the rear cover 212, and the front cover 211 and the rear cover 212 are parallel to each other in the up-down direction. The front cover 211 has an air inlet 215, and the air inlet 215 faces downward to form a horizontal range hood. The rear cover 212 of the volute 21 has a first air outlet 217, and the first air outlet 217 has a direction opposite to that of the air inlet 215. The position of the first air outlet 217 can correspond to the volute tongue 214. The rear covers 212 of the two volutes 21 can be integrated as a whole, so that two first air outlets 217 in the two fan systems 2 are communicated with each other as a whole.

In addition, the front cover 211, the rear cover 212 and the annular wall 213 also form a second air outlet 216, and the second air outlet 216 faces backward. The second air outlet 216 is an air outlet commonly used in the centrifugal fan. The volute tongue 214 distributes an air flow driven by the impeller 22 into the first air outlet 217 and the second air outlet 216, thereby preventing most of the air flow from flowing back to the volute 21. The annular wall 213 has an opening, so that the annular wall 213 has a first end 2131 and a second end 2132 that face upward. The second air outlet 216 is a space among the two ends of the annular wall 213, the front cover 211 and the rear cover 212. The volute tongue 214 is close to the first end 2131.

The range hood of the present invention has two fume discharging and mounting modes. In the first mode, fume is discharged upward, and a fume discharge pipe (not shown) can be disposed above the range hood and extend longitudinally. At this time, the air flow is discharged upward from the first air outlet 217. In order to make the air flow originally flowing from the second air outlet 216 turn 90° and be discharged upward, a flow guide device 4 is disposed at the second air outlet 216, and the flow guide device 4 has a flow guide surface 41. The flow guide surface 41 faces the air flow, and the first air outlet 217 also covers the flow guide surface 41. The flow guide device 4 blocks the second air outlet 216, thereby preventing oil fume from being discharged from the second air outlet 216. In order to further ensure the airtightness of the second air outlet 216, in this mounting mode, a back cover 24 can be disposed at the second air outlet 216, so that oil fume will not be discharged from the second air outlet 216.

The range hood further comprises a first air outlet hood 31. A through hole 11 is disposed at a position on the top of the housing 1 corresponding to the first air outlet 217. The shape of the through hole 11 is the same as the overall shape of the two first air outlets 217. The first air outlet hood 31 is disposed above the housing 1 and covered at the through hole 11, so that the fan system 2 can be connected to the fume discharge pipe and it is convenient for oil fume discharged from the fan system 2 to enter the fume discharge pipe. The first air outlet hood 31 in the present invention can be the same as the air outlet hood used in common range hoods in structure. In this embodiment, the first air outlet hood 31 is in a square-to-round structure.

The housing 1 further comprises a back plate 12 located on the rear side of the whole machine to mount and fix the whole range hood to the wall (not shown).

Figure 15:
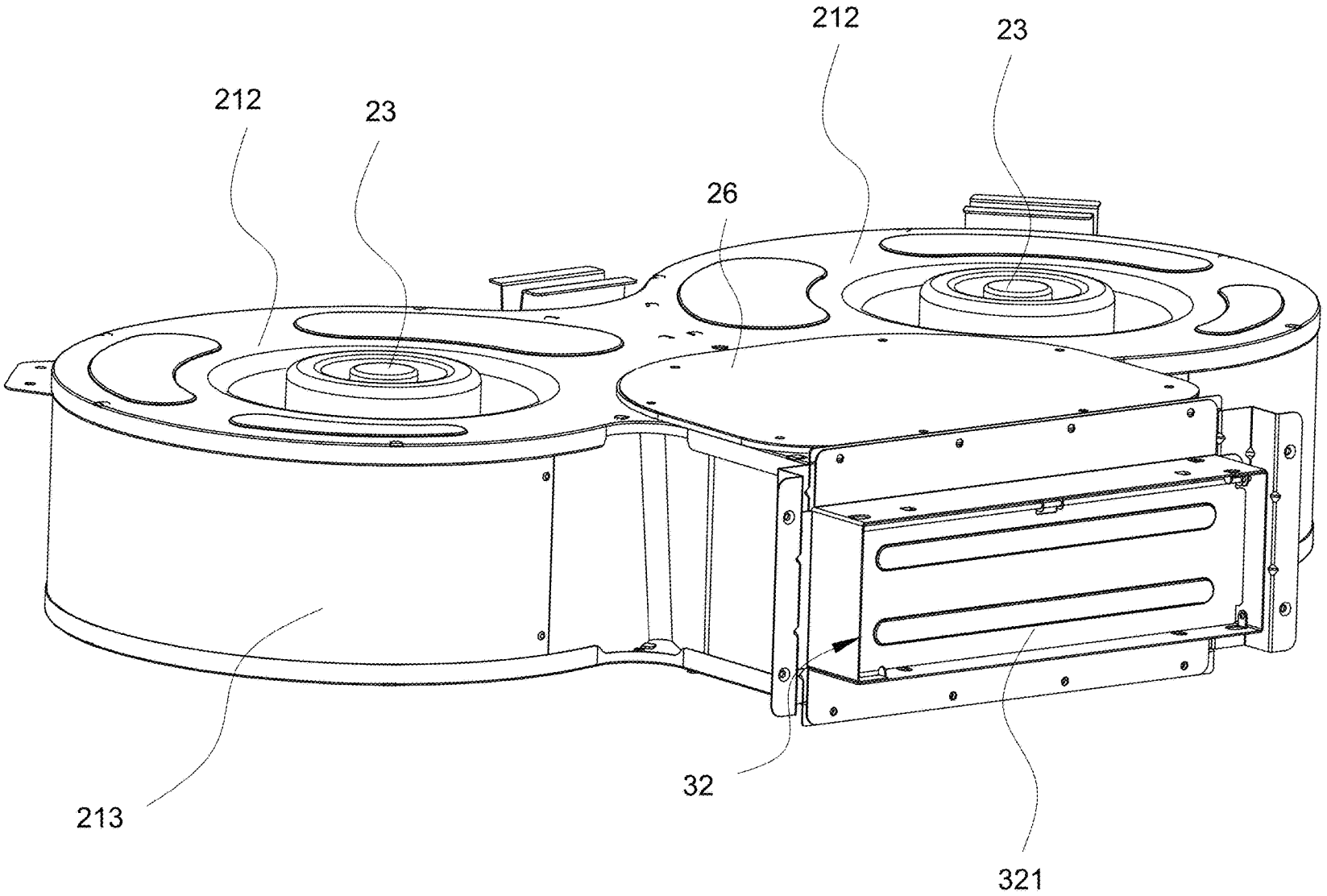
FIG. 15 is a perspective view of the range hood in a state where the air is discharged from the back according to the embodiment of the present invention.
Figure 16:
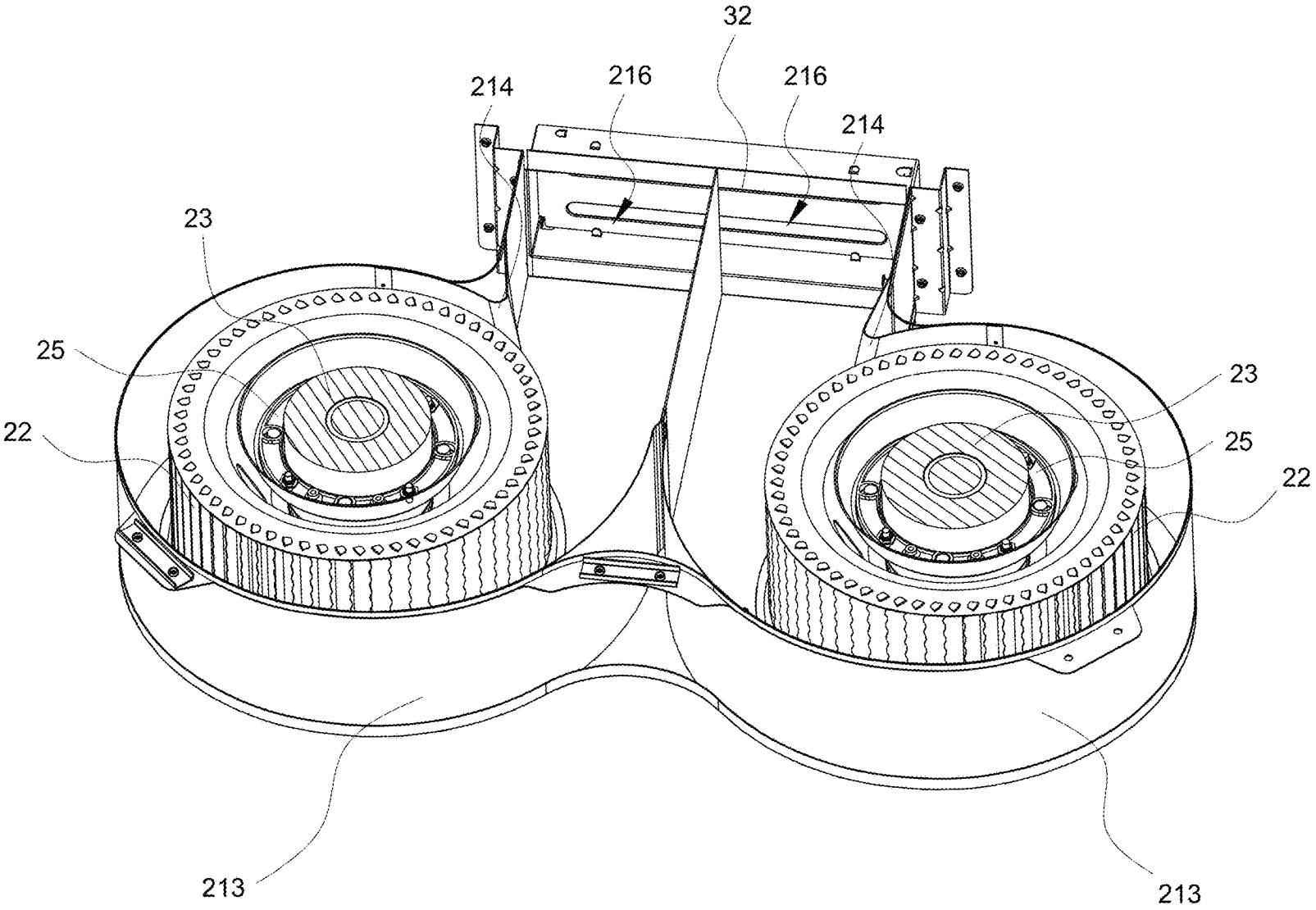
FIG. 16 is a sectional view of the range hood of FIG. 15 when the housing is omitted (sectioned along the horizontal direction from front to rear)

With reference to FIGS. 15 and 16, the range hood is mounted in a mode where air is discharged from the top. When air needs to be discharged from the back, the fan system 2 is connected to the fume discharge pipe. At this time, the fume discharge pipe is disposed in the rear of the range hood and transversely extends in the front-rear direction. At this time, a top cover 26 is disposed at the first air outlet 217 of the rear cover 212 of the volute 21 to block the first air outlet 217. The second air outlet 216 communicates the inside of the volute 21 with the outside of the range hood, that is, it is unnecessary to dispose a back cover 24 at the second air outlet 216. Meanwhile, since the air flow can be discharged from the second air outlet 216 without turning 90°, it is unnecessary to dispose the flow guide device 4.

Similar to the mode where air is discharged from the top, a through hole (not shown) can also be disposed at a position on the back plate 12 of the housing 1 corresponding to the second air outlet 216 to facilitate the flowing of the air flow. A second air outlet hood 32 is disposed at the second air outlet hood 216. Similar to the existing air outlet hoods, the second air outlet hood 32 also has a check valve 321. The two second air outlets 216 share one second air outlet hood 32. The wall is located on the rear side of the second air outlet hood 32. In this embodiment, the first air outlet hood 31 is of a square-to-square hood structure, which is suitable for square fume discharge pipes.

To sum up, when the range hood discharges air from the top, the flow guide device 4 and the back cover 24 are hermetically assembled; and, when the range hood discharges air from the back, the top cover 26 is sealing. During the whole disassembly process, the top cover 26 and the back cover 24 are located outside the volute 21, so that it is convenient for assembly.

With reference to FIGS. 11-14, in this embodiment, the definition of the profile line of the volute is the same as that in the prior art. The intersection of the annular wall 213 and the rear cover 212 (a projection line on a horizontal plane in the horizontal arrangement state) is defined as a first profile line L1 of the volute 21, and the intersection of the annular wall 213 and the front cover 211 is defined as a second profile line L2 of the volute 21 (a projection line on the horizontal plane in the horizontal arrangement state). The profile line of the volute in the present invention adopts a multi-segment fitting method to adapt to the complex and changeable flow field in the parallel double fan systems of thin range hoods.

The first profile line L1 comprises a first line segment $AP_3$, a second line segment $P_3P_0$, a third line segment $P_0D$, a fourth line segment DE, a fifth line segment EF and a sixth line segment FG that are smoothly connected in turn, wherein the starting point of the first line segment $AP_3$ is A; the ending point of the sixth line segment FG is G; the points A and G are respectively the starting point and ending point of the first profile line L1; the point A is located at the first end 2131 of the annular wall 213; and the point G is located at the second end 2132 of the annular wall 213.

The second profile line L2 comprises a first line segment $AP_3$, a seventh line segment $P_3P_0'$, an eighth line segment $P_0'P_0$, a third line segment $P_0D$, a fourth line segment DE, a fifth line segment EF and a sixth line segment FG that are smoothly connected in turn, wherein the starting point of the first line segment $AP_3$ is A; the ending point of the sixth line segment FG is G; the points A and G are respectively the starting point and ending point of the second profile line L2; the point A is located at the first end 2131 of the annular wall 213; and the point G is located at the second end 2132 of the annular wall 213. Except for the seventh line segment $P_3P_0'$ and the eighth line segment $P_0'P_0$, the remaining line segments of the second profile line L2 are the same as the corresponding line segments of the first profile line L1 and thus are represented by the same signs in the present invention. In the present invention, the same here means the coincidence of projections in the axial direction of the impeller 22.

Figure 13:
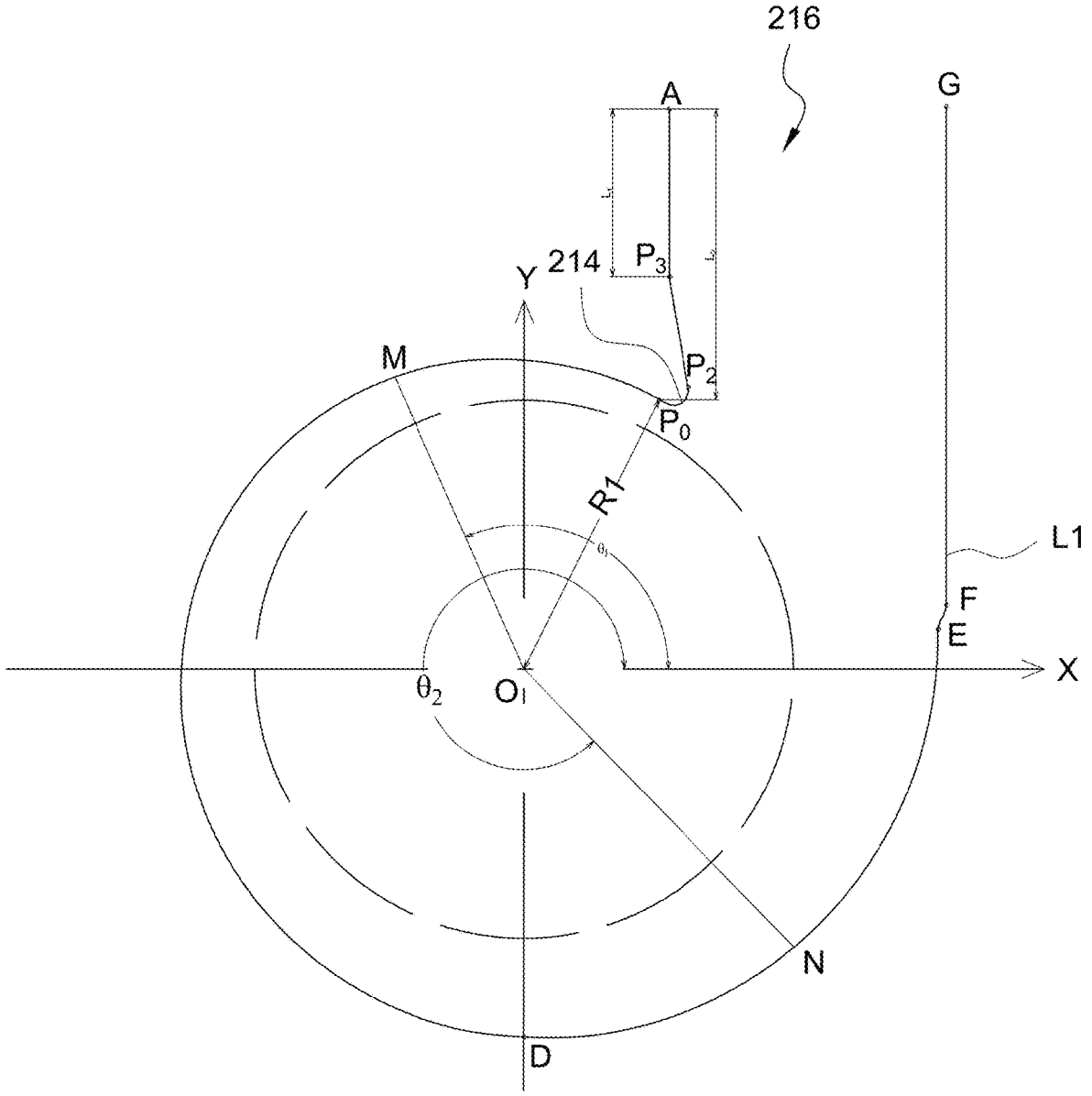
FIG. 13 is a schematic diagram of the first profile line of the volute of the fan system according to the embodiment of the present invention.
Figure 14:
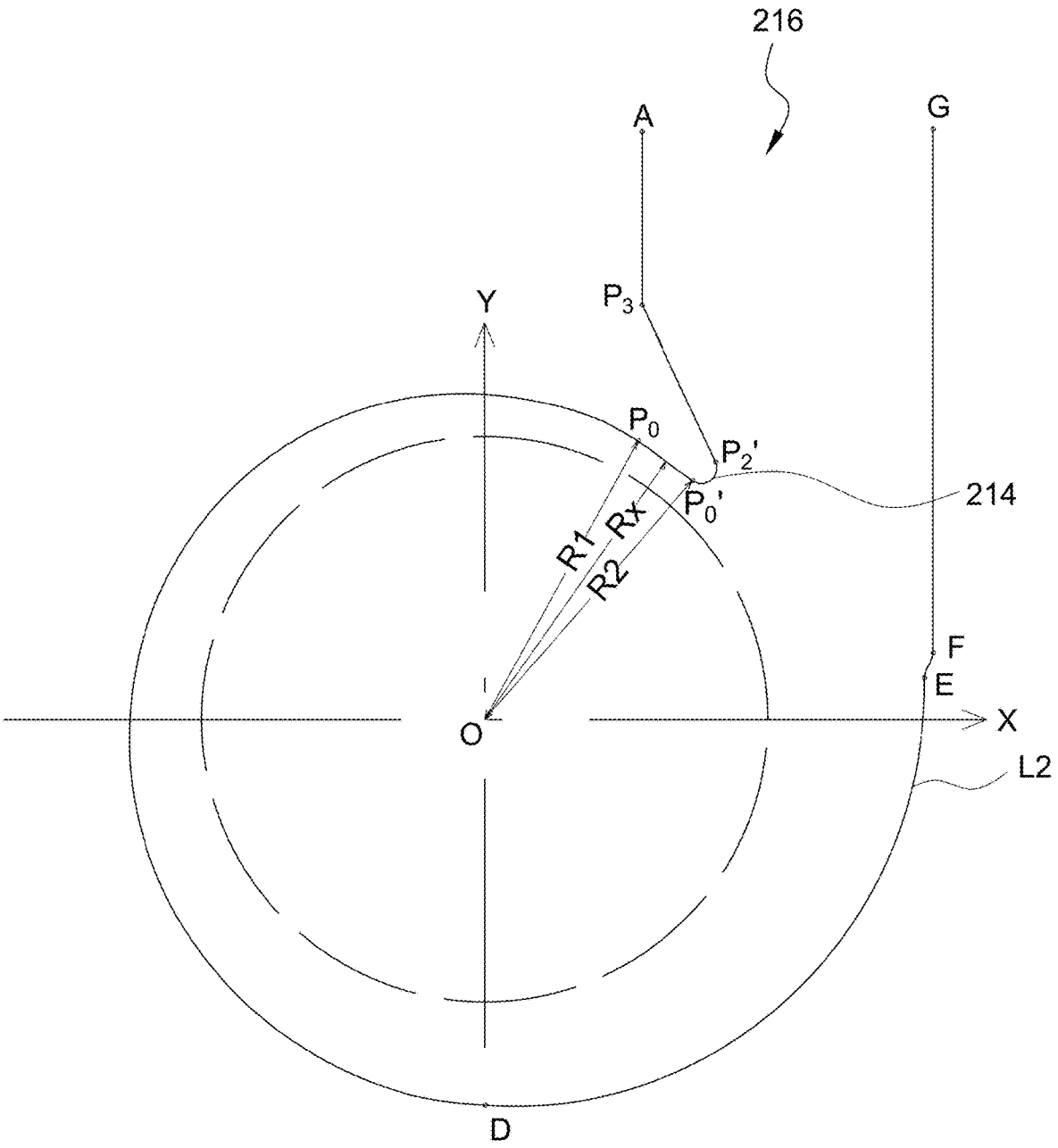
FIG. 14 is a schematic diagram of the second profile line of the volute of the fan system according to the embodiment of the present invention.

The dashed circles in FIGS. 13 and 14 indicate the profile line of the impeller 22.

Since the parallel double fan system of the present invention has two air discharge modes, the fan system 2 mainly discharges air from the top and also discharges air from the back. In the mode where air is discharged from the top, the air flow discharged from the volute 21 turns 90° through the flow guide device 4 and is then discharged by the first air outlet hood 31 or other air outlet structures. Although the flow guide device 4 plays a flow guide role, the sharp turning of the air flow at a certain velocity will inevitably lead to a great change in the internal fluid velocity and pressure, and this change will result in the loss of effective energy and the aerodynamic noise. In order to reduce the energy loss caused by the sharp turning of the discharged air flow, in the process of designing the profile line of the volute, the velocity of the profile line of the volute near the first air outlet 217 should be appropriately reduced and the pressure should be appropriately increased. In addition, this parallel double fan system has little influence on the air inlet condition. However, since the first air outlets 217 of the two fan systems 2 are communicated with each other, that is, the first air outlets form one air outlet for discharging air, it is required that the profile line of the air outlet of the parallel double fan system is obviously different from that of the single-fan system.

In order to solve two problems that two air discharge modes are taken into consideration and the parallel double fan system shares one air outlet structure, the first line segment AP3 and the sixth line segment FG are straight lines, and the second line segment P3P0, the third line segment P0D, the fourth line segment DE and the fifth line segment EF are curves. In order to conveniently describe the profile line of the volute, the following coordinate system of the first profile line L1 is established: an intersection point that an axis of the impeller 22 passing through the plane of the first profile line L1 is defined as an origin of coordinates O, the horizontal coordinate axis is defined as an X-axis, and the vertical coordinate axis is defined as a Y-axis; the first line segment AP3 and the sixth line segment FG are located in a first quadrant of the coordinate system.

With reference to FIG. 13, the smoothness of the flow field at the first air outlet 217 and the adaptability of the internal structure of the internal flow field are taken into consideration. Both the first line segment $AP_3$ and the sixth line segment FG are straight line segments parallel to the Y-axis. In order to facilitate the two fan systems 2 to share the same first air outlet hood 31 or other air outlet structures, since the air flow passing through the first air outlet 217 of the volute 21 tends to move to the first line segment $AP_3$ and if the first line segment $AP_3$ is inclined right and has an included angle with the Y-axis, an air flow colliding with the wall where the first line segment $AP_3$ is located will be produced, thereby increasing aerodynamic noise. If the first line segment $AP_3$ is inclined left and has an included angle with the Y-axis, an air flow at the connection of the first air outlet 217 and the first air outlet hood 31 will collide with the first air outlet hood 31, and excessive noise will also be produced. Therefore, preferably, the first line segment $AP_3$ is a straight line segment.

Since the first air outlets 217 of the two volutes 21 are communicated with each other, air flows in the two first air outlets 217 are converged and then discharged through the first air outlet hood 31. In order to prevent the collision of two air flows from producing noise, it is required that the sixth line segment FG is a straight line parallel to the Y-axis. Thus, the two air flows flow in parallel when being converged, so that additional mixing of the air flows due to different velocities and directions is reduced. In order to the air discharge mode where the fan system 2 mainly discharges air from the top and also discharges air from the back, the second line segment $P_3P_0$ is a Bezier spline curve, as described in detail below.

Due to the parallel connection of the double fan system and the smooth air inlet conditions, it is necessary to increase the pressure and velocity at the volute 21 near the air inlet 215 so as to ensure the requirements for the performance of the whole machine and the pressure of flow. However, as described above, the two volutes 21 are shared for discharging air, so a certain flow loss will be caused when the first profile line L1 is close to the first air outlet 217 and when two air flows are converged. In addition, when an air flow turns 90° at the first air outlet 217, the velocity changes sharply, and the flow loss will be further increased. Therefore, in the design of the profile line of the volute, it is necessary to relieve the flow loss caused by the convergence of two air flows and the flow loss caused by 90° turning of the air flow at the outlet, so as to ensure the requirements for flow.

Therefore, the third line segment $P_0D$ adopts a spiral line with an equal spiral angle. In the spiral line equation, the coordinate of any point M is Y=R1*exp(A*θ1). This process is a process of increasing pressure and velocity in the volute 21, so that the requirements for the performance of the whole machine and the flow pressure are ensured. R1 and A are constants, and θ1 is an included angle between the ligature MO of any point M with the origin of coordinates O and the positive direction of the X-axis. In this embodiment, the coordinate of the starting point $P_0$ of the third line segment $P_0D$ is (68,120.2), and the coordinate of the ending point D of the third line segment $P_0D$ is (0,−174.0). The parameters R1 and A can be determined by the coordinate values of the two points, so that the equation of the whole third line segment $P_0D$ is obtained.

The fourth line segment DE adopts a spiral line with a variable spiral angle, and the size of the spiral angle gradually decreases with the increase of the angle (the increase of the angle means the increase of the angle in the positive direction of the X-axis, that is, in the anticlockwise direction). The spiral line equation of the fourth line segment DE, that is, the coordinate of any point N on the fourth line segment is Y=R2*exp(B*θ*tan($\lambda_1$)), where R2 and B are constants, θ1 is an included angle between the ligature NO of any point N with the origin of coordinates O and the positive direction of the X-axis, and the tapered spiral divergence angle $\lambda_1$ satisfies the following condition: $\lambda_1 \in [4°,6°]$. The curve is designed to play a role of increasing pressure and stabilizing velocity. Firstly, it is designed to make the volute 21 adapt to the flow field of the first air outlet 217 after a 90° sharp turn, so that the flow loss is reduced as far as possible by reducing the velocity and increasing the pressure. Secondly, it is designed to coordinate the two firs air outlets 217 of the parallel double fan system to converge two air flows into one air flow. The coordinate of the ending point E of the fourth line segment DE is (192.6,−1.2). The parameters R2 and B can be determined by the coordinate values of the starting point D and ending point E of the fourth line segment DE.

Figure 7:
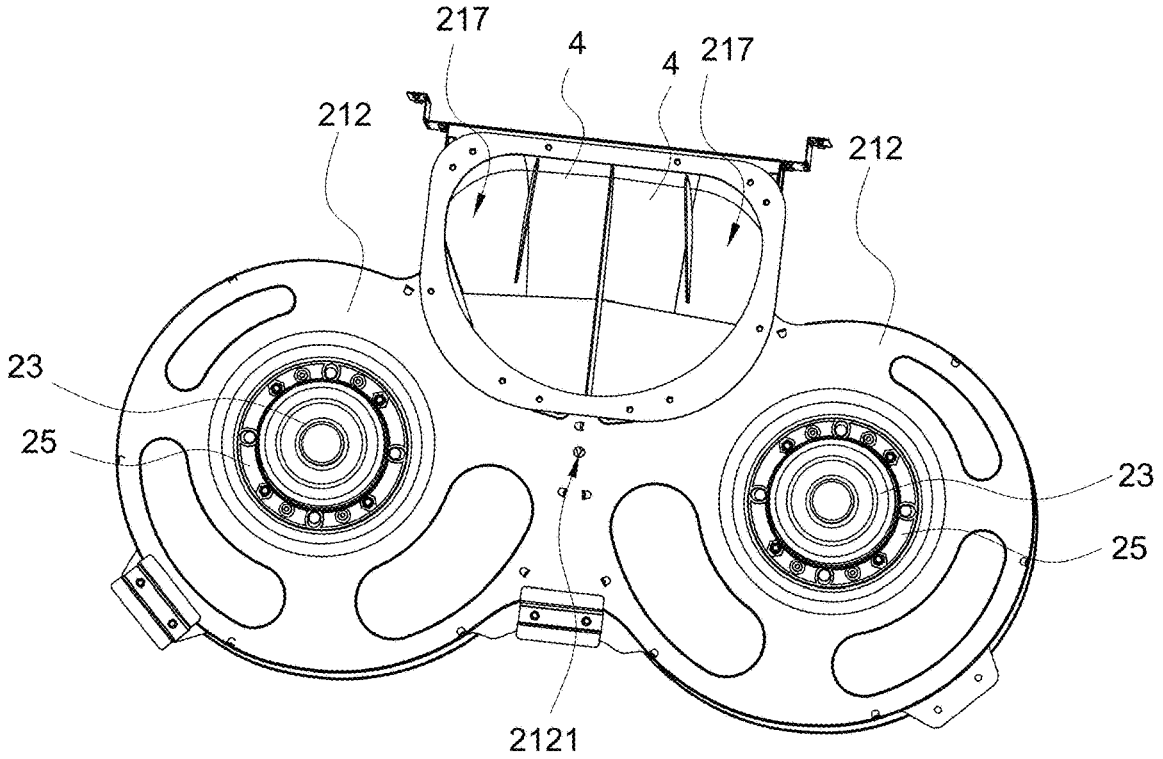
FIG. 7 is a perspective view of the fan system according to the embodiment of the present invention (viewed from the top)
Figure 8:
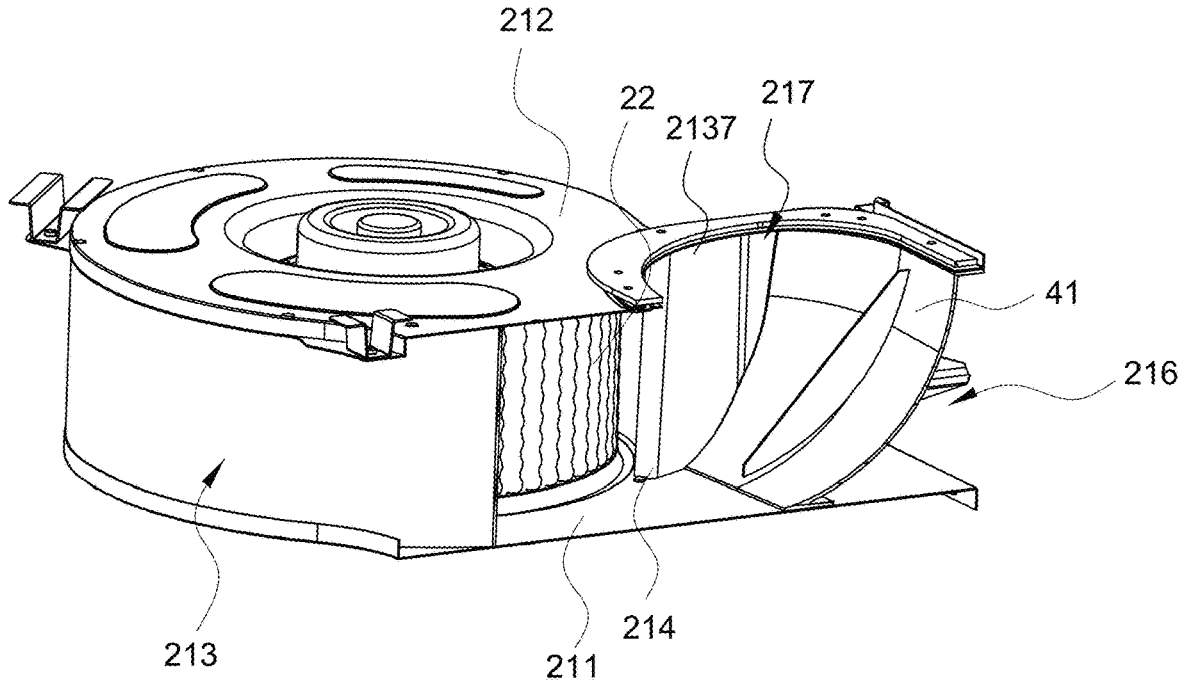
FIG. 8 is a sectional view of one fan in the fan system according to the embodiment of the present invention.

Due to the mounting requirements of the whole machine, with reference to FIG. 7, in the process of mounting the range hood, a plurality of screws will pass through the housing 1. Therefore, a plurality of evading holes 2121 for receiving the screws are disposed in the middle of the rear covers 212 of the two fan systems 2, so that it is convenient to mount the screws into the volutes 21. In order to prevent the interference between the screws and the annular wall 213 from affecting the performance of the whole machine, the annular wall 213 needs to evade the evading holes 2121, that is, the annular wall 213 needs to evade screws. The evading holes 2121 can have a diameter of 8 mm.

The fifth line segment EF is smoothly connected between the fourth line segment DE and the sixth line segment FG, and the fifth line segment EF needs to satisfy the evasion of the evading holes 2121 having a diameter of 8 mm. According to the law of movement of the cylindrical turbulent flow field, the fifth line segment EF is a Bezier curve, more preferably a biquadratic Bezier curve. The fifth line segment EF is to adapt to the smooth transition between the fourth line segment DE and the sixth line segment FG and ensure that the fourth line segment DE is located on the same side of the sixth line segment FG, so that the air flow near the first air outlet 217 of the volute 21 is increased in pressure and also ensured in flow. Here, the same side means that the X-coordinates of the fourth line segment DE are less than the X-coordinates of the sixth line segment FG; the ending point F of the fifth line segment EF corresponds to the intersection point of the annular wall 213 the position near the rear cover 212 and the first air outlet 217. The intersection is a position of the first air outlet 217 farthest away from the second air outlet 216. The first air outlet 217 extends from the intersection to the second air outlet 216, but the shape of the remaining part of the first air outlet 217 will not be limited.

Preferably, the biquadratic Bezier curve gives 5 coordinate vectors, that is, point E (192.6,−1.2), three intermediate coordinate vectors (192.4,13), (195.2,−22) and (199.4,16), the three coordinate vectors provide a vector direction for the trend of the curve and are unnecessarily located on this curve, and point F (198.6,27.5). A spline curve, that is, the fifth line segment EF, can be obtained from the biquadratic Bezier curve equation $B(t)=P_0''*t^4+P_1''*4*t^2*(1-t)^2+P_2''*6*t^2*(1-t)^2+P_3''*4*t^3*(1-t)+P_4''*(1-t)^4$. Here, $P_0''$, $P_1''$, $P_2''$, $P_3''$ and $P_4'$ are the coordinates of five points from the point E to the point F in turn.

The annular wall 213 comprises a first air outlet sidewall 2133, a volute tongue 214, an annular wall main portion 2134, a transition wall 2135 and a second air outlet sidewall 2136, wherein the profile line of the first air outlet sidewall 2133 corresponds to the first line segment $AP_3$; the profile line at a side of the annular wall main portion 2134 intersected with the rear cover 212 corresponds to the third line segment $P_0D$ and the fourth line segment DE; the profile line at a side of the annular wall main portion 2134 intersected with the front cover 211 corresponds to the eighth line segment $P_0'P_0$, the third line segment $P_0D$ and the fourth line segment DE; the profile line of the transition wall 2135 corresponds to the fifth line segment EF; the profile line of the second air outlet sidewall 2136 corresponds to the sixth line segment FG.

Figure 17:
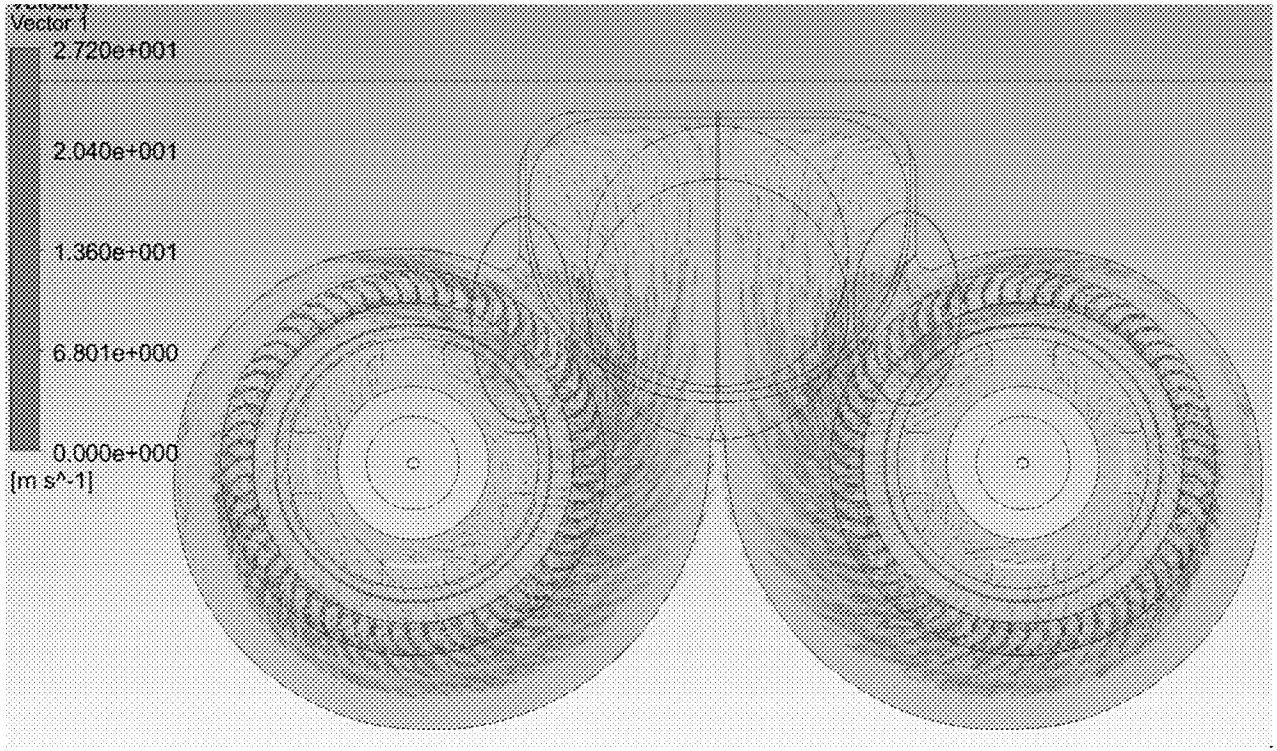
FIG. 17 is a schematic diagram of a flow field in the volute of the parallel double fan system in the prior art.

The fan system 2 of the present invention mainly discharges air from the top, and a 90° turn needs to be made at the first air outlet 217; however, the air low at the first air outlet 217 has a high velocity. At this turn, the flow loss caused by the turning of the air flow is high, and an obvious backflow phenomenon will occur at the volute tongue 214. With reference to FIG. 17, the backflow has been marked in the figure. The backflow phenomenon is mainly manifested in that the air flow at the first air outlet 217 has a higher pressure at the 90° turning position while the air flow has a lower flow velocity on the side of the volute 21 at the first air outlet 217 close to the volute tongue 214. At the front cover 211 of the volute 21 and at a position far away from the first air outlet 217, the pressure is obviously higher, while there is a negative pressure region in the impeller 22. This difference in pressure makes the air flow near the volute tongue 214 flow back to the impeller 22.

Figure 9:
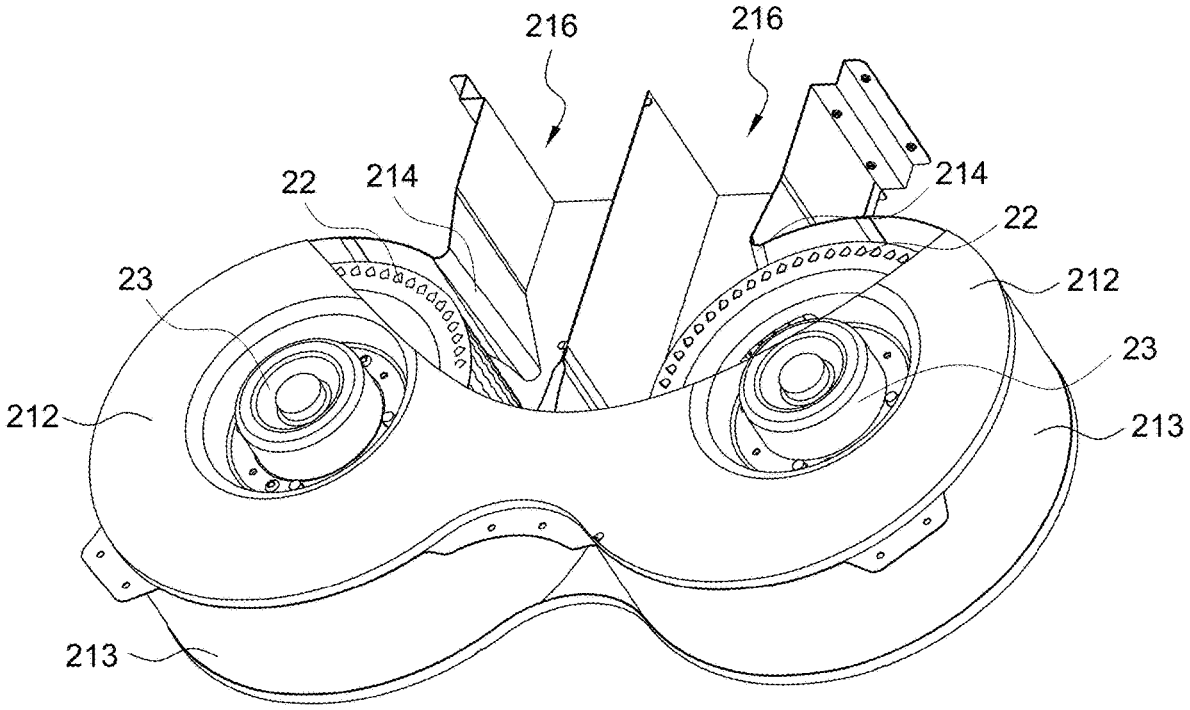
FIG. 9 is a perspective view of the fan system according to the embodiment of the present invention when parts of the rear cover and the flow guide device are omitted.
Figure 10:
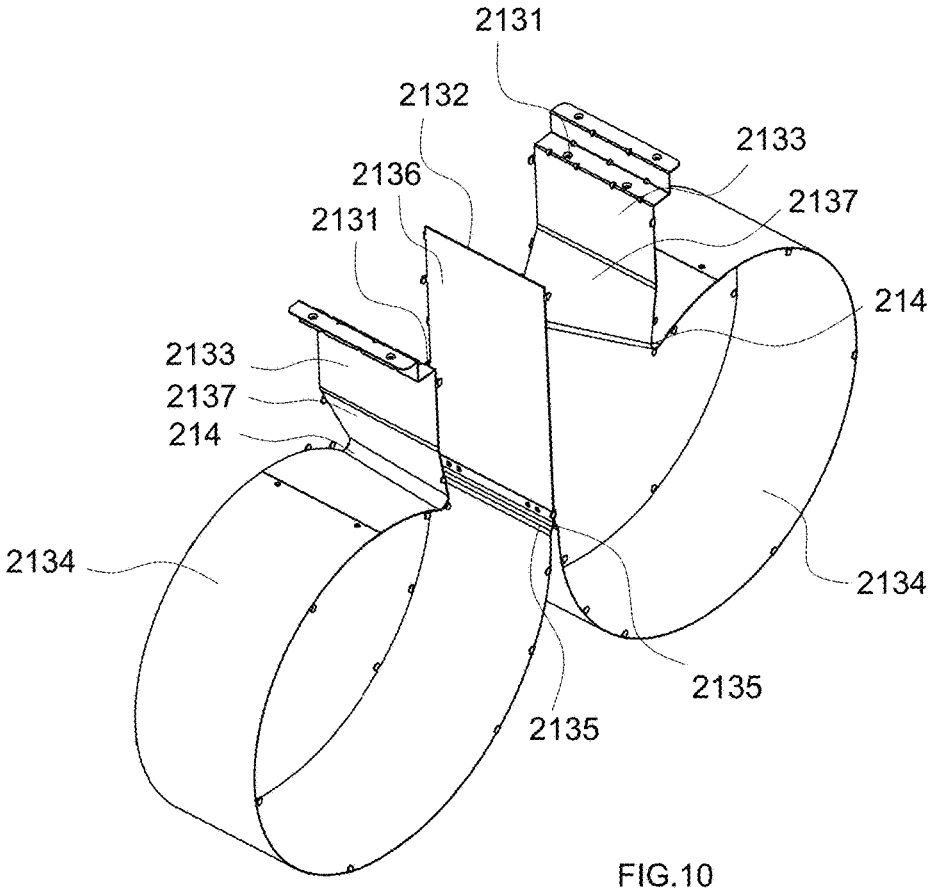
FIG. 10 is a perspective view of an annular wall of the fan system according to the embodiment of the present invention.
Figure 11:
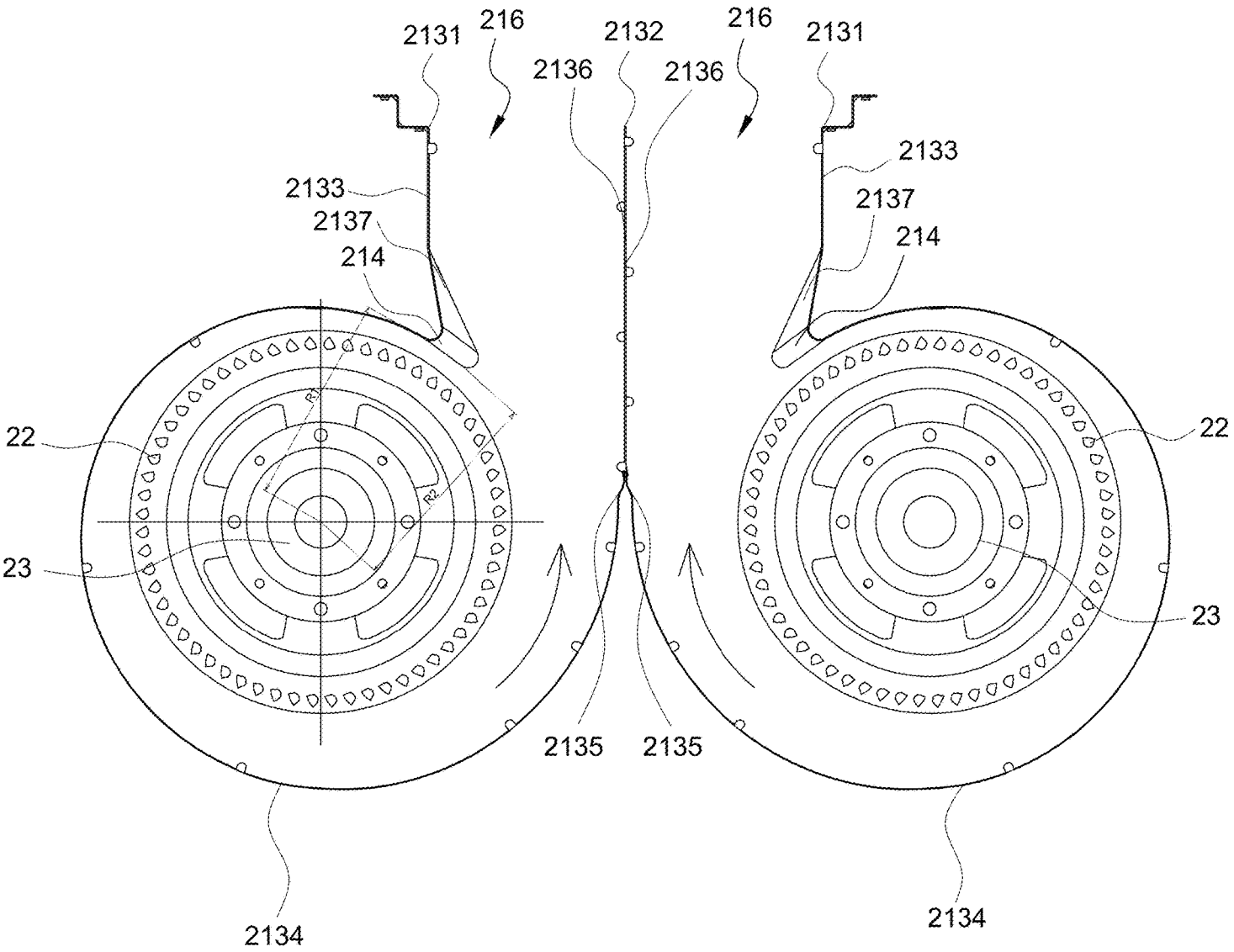
FIG. 11 is a top view of the fan system according to the embodiment of the present invention (the front cover and the rear cover of the volute are omitted)
Figure 12:
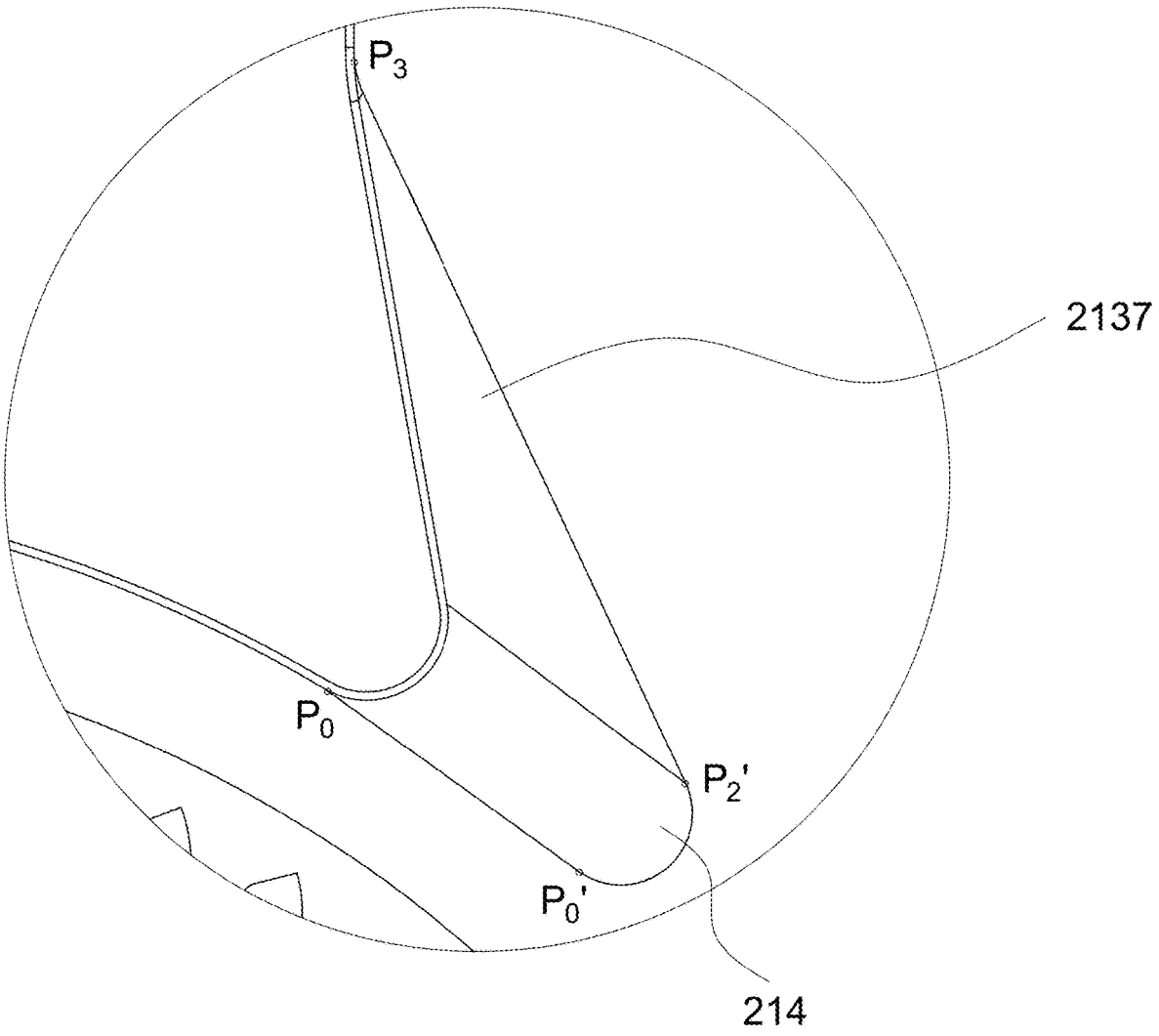
FIG. 12 is an enlarged view of Part-I of FIG. 11.

With reference to FIGS. 9-11, in order to relieve the aerodynamic noise caused by the backflow phenomenon, the volute tongue 214 is spline curves at the intersection of the rear cover 212 and the front cover 211 and the spline curves are different spline curves. This double-spline curve design is manifested in that the volute tongue 214 is gradually inclined from the rear cover 212 to the front cover 211 in a direction opposite to the rotation direction of the impeller 22. The rotation direction of the impeller 22 is shown by the arrow in FIG. 11.

Figure 4:
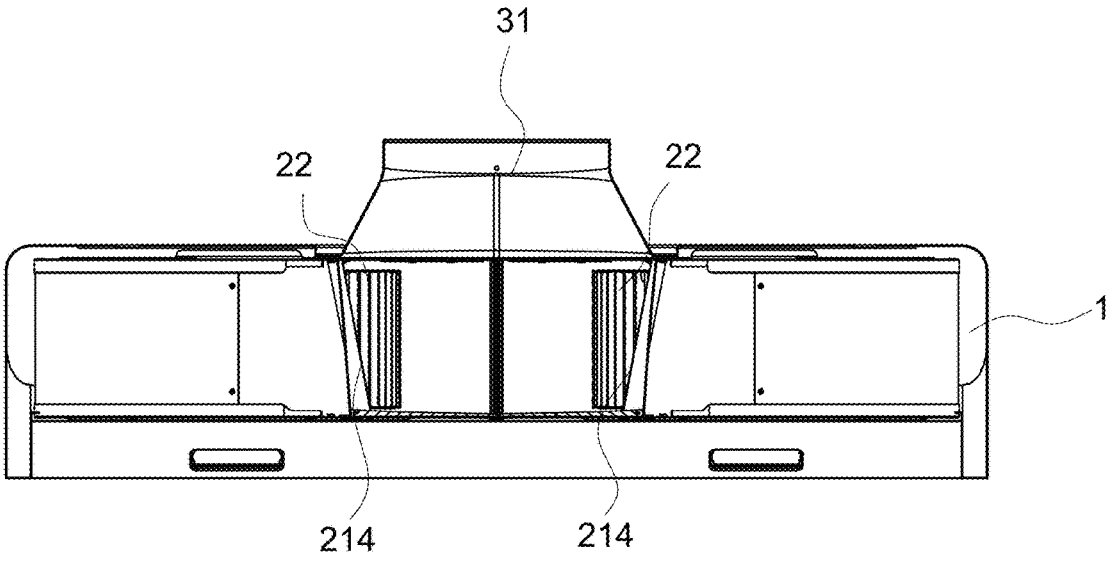
FIG. 4 is a sectional view of the range hood of FIG. 1 (sectioned along the vertical direction from left to right and viewed from the rear)
Figure 5:
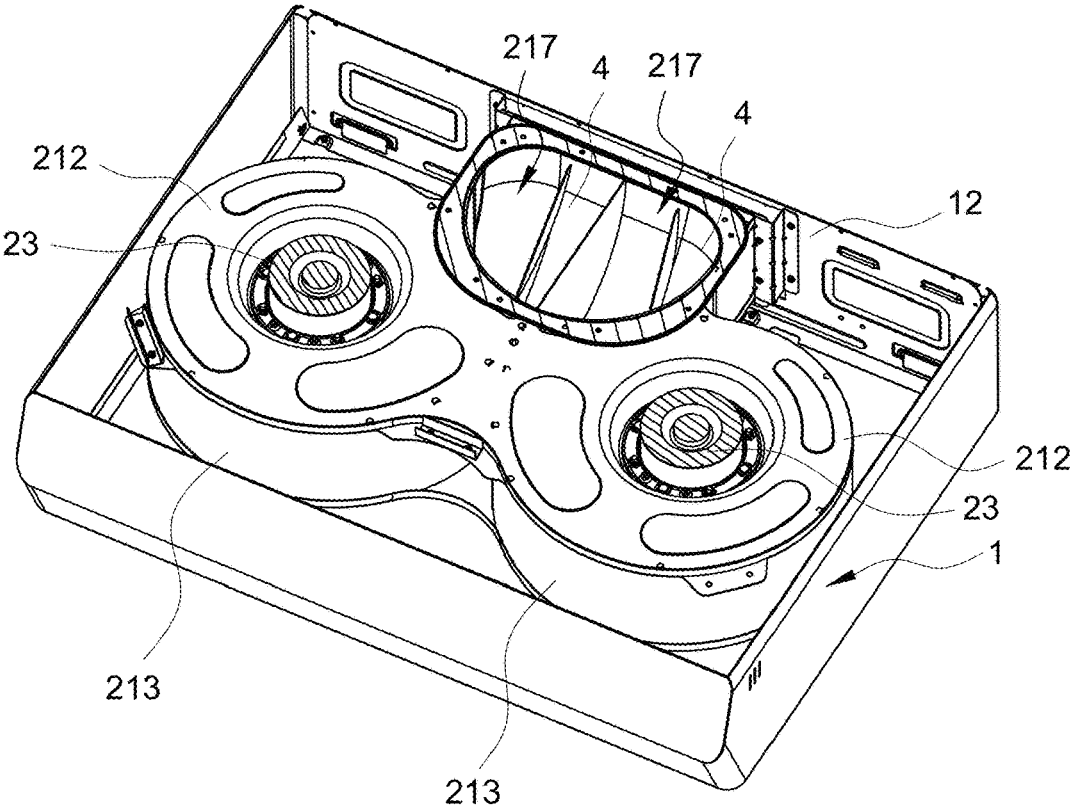
FIG. 5 is a sectional view of the range hood of FIG. 1 (sectioned along the horizontal direction from front to rear)
Figure 6:
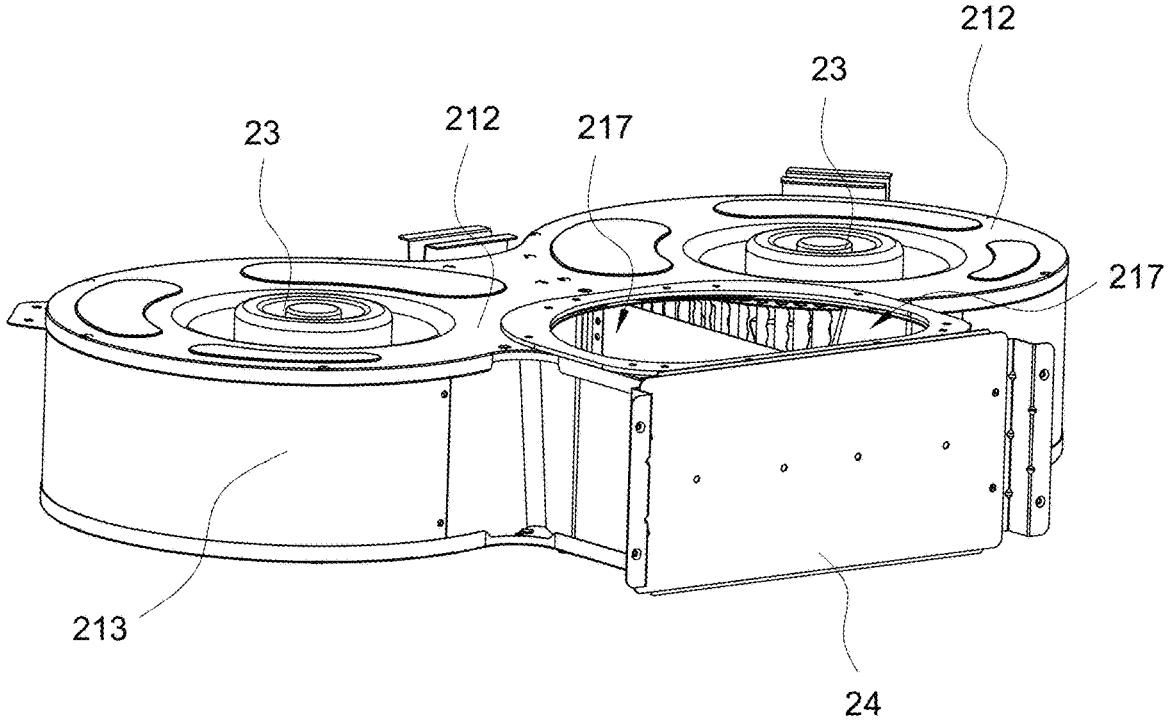
FIG. 6 is a perspective view of the parallel double fan system according to the embodiment of the present invention (viewed from the rear)

The annular wall 213 further comprises an extension wall 2137 connected between the first air outlet sidewall 2133 and the volute tongue 214. The profile line of a side of the volute tongue 214 and the extension wall 2137 intersected with the rear cover 212 is the second line segment $P_3P_0$, and the profile line of a side of the volute tongue 214 and the extension wall 2137 intersected with the front cover 211 is the seventh line segment $P_3P_0'$. Since the volute tongue 214 is inclined, the volute tongue 214 and the extension wall 2137 are an inclined flow guide curved surface on a side facing the volute 21 as a whole, and the inclined flow guide curved surface can correspond to the flow guide surface of the flow guide device 4. The effective air discharge area formed by the unit cross-sectional area formed by the corresponding surface of the curved surface in the axial direction of the impeller 22 gradually increases from the front cover 211 to the rear cover 212, as shown in FIG. 4. Since the impeller 22 has almost equal capacity of doing work in the axial direction, the air flow accelerated by the impeller 22 is pressurized by the volute 21 and has almost equal velocity V near the volute tongue 214 in the axial direction. The double-spline curve design of the volute tongue 214 makes the volute tongue 214 and the extension wall 2137 have a gradually variable cross-section structure in the axial direction. The effective air discharge area S formed by the unit cross-section gradually increases from the front cover 211 to the rear cover 212 in the axial direction. Therefore, the flow at this position is Q=S*V, and the air flow near the rear cover 212 has a high flow, so that it is convenient to discharge air near the first air outlet 217. The flow passing through the volute tongue 214 far away from the first air outlet 217 and near the front cover 211 is relatively low. During the assembling of the volute 21 and the flow guide device 4, near the front cover 211 of the volute 21, the space between the volute tongue 214 and the flow guide device 4 is relatively small and is just matched with the design of the volute tongue, so that the movement of the air flow in the whole space in the volute 21 is relatively stable. Thus, the backflow phenomenon caused by no gas discharge due to a small space between the volute tongue 214 near the front cover 211 and the flow guide device 4 is reduced, and the collision of the backflow gas caused by backflow and two air flows at the outlet of the impeller 22 at the volute tongue 214 is obviously improved, so that the aerodynamic noise at this position is obviously improved. The curved surface plays a flow guide role in the whole internal flow field to guide the airflow to flow to the outlet.

Specifically, the inclined extension of the volute tongue 214 is formed in the following way. With reference to FIGS. 11-14, the first profile line L1 and the second profile line L2 do not coincide at the volute tongue 214. In the first profile line L1, the second line segment $P_3P_0$ comprises a ninth line segment $P_3P_2$ and a tenth line segment $P_2P_0$, wherein the ninth line segment $P_3P_2$ is a profile line at the intersection of the extension wall 2137 and the rear cover 212, and the tenth line segment $P_2P_0$ is a profile line at the intersection of the volute tongue 214 and the rear cover 212. In the first profile line L1, the radius at the ending point $P_0$ of the volute tongue 214 is R1. In the second profile line L2, the seventh line segment $P_3P_0'$ comprises an eleventh line segment $P_3P_2'$ and a twelfth line segment $P_2'P_0'$, wherein the eleventh line segment $P_3P_2'$ is a profile line at the intersection of the extension wall 2137 and the front cover 211, the twelfth line segment $P_2'P_0'$ is a profile line at the intersection of the volute tongue 214 and the front cover 211, and the eighth line segment $P_0'P_0$ corresponds to a profile line of the starting part at the intersection of the annular wall main portion 2134 and the front cover 211. In the second profile line L2, the radius at the ending point $P_0'$ of the volute tongue 214 is R2. That is, the ending point of the profile line of the volute tongue 214 gradually extends to the ending point of the profile line of the volute in a direction from the rear cover 212 to the front cover 211.

In the first profile line L1, the ending point of the profile line of the volute tongue 214 is $P_0$; and, in the second profile line L2, there is a point $P_0$ corresponding to the point $P_0$ (that is, the point coincided with the projection of the impeller 22 in the axial direction), the ending point of the profile line of the volute tongue 214 is $P_0'$, and the eighth line segment $P_0'P_0$ can be in an arc shape, a spiral line or other divergent spline curves. The radius of any point on the eighth line segment $P_0'P_0$ is Rx, and satisfies the following condition: R2≤Rx≤R1.

The first line segment $AP_3$ has a length of L1, $AP_0$ has a length of L2, and $AP_0$ is parallel to the Y-axis. Since the space in the volute 21 is limited, the range of L2:L1 is preferably [1.7, 2.3], more preferably 2.0. The second line segment $P_3P_0$ of the first profile line L1 is preferably a Bezier curve, and the seventh line segment $P_3P_0'$ and the eighth line segment $P_0'P_0$ of the second profile line L2 are also preferably Bezier curves, more preferably cubic Bezier curves. By using the origin of coordinates O as a coordinate vector, the coordinate vectors of four points involved in the seventh line segment $P_3P_0'$ and the eighth line segment $P_0'P_0$ of the second profile line L2 are respectively Q1(92,103), Q2(107.5,99), Q3(106.9,107.6) and Q4(69.6,178), wherein Q1, Q2, Q3 and Q4 respectively correspond to $P_0$, $P_0'$, $P_2'$ and $P_3$. The coordinates of four points involved in the second line segment $P_3P_0$ in the first profile line L1 are respectively Q1(68,120.2), Q2(83.6.117.4), Q3(79.6,126.2) and Q4(69.6, 178), wherein Q1 and Q4 respectively correspond to $P_0$ and $P_3$ and are points on the curve, Q2 and Q3 are vectors on the curve, and the spline curve does not pass through the points. A spline curve can be obtained from two spline curves according to respective vector coordinate values Q1, Q2, Q3 and Q4 by using the cubic Bezier curve equation B(t)= Q1*t^3+Q2*3*t^2*(1−t)+Q3*3*t*(1−t)^2+Q4*(1−t)^3.

To sum up, the spline curve of the profile line of the whole volute is formed by the above line segments. Under the constraints of the above equations, the first profile line L1 is allowed to be scaled within 0.9 to 1.1.

What is claimed is:

1. A parallel double fan system, comprising:

two fan systems disposed in parallel;

wherein each fan system comprises a volute (21) having a front cover (211), a rear cover (212) and an annular wall (213) connected between the front cover (211) and the rear cover (212);

wherein, the annular wall (213) has a volute tongue (214);

the front cover (211) has an air inlet (215);

the rear cover (212) has a first air outlet (217) located above the corresponding volute tongue (214), the two first air outlets (217) in the two fan systems are communicated with each other;

an intersection of the annular wall (213) and the rear cover (212) is defined as a first profile line (L1) of the volute (21), the first profile line (L1) comprises a first line segment ($AP_3$), a second line segment ($P_3P_0$), a third line segment ($P_0D$), a fourth line segment (DE), a fifth line segment (EF) and a sixth segment (FG) that are connected in turn;

a starting point of the first line segment ($AP_3$) and an ending point of the sixth line segment (FG) are respectively a starting point and an ending point of the first profile line (L1), and an ending point of the second line segment ($P_3P_0$) corresponds to an ending point of the volute tongue (214) in the first profile line (L1);

the third line segment ($P_0D$) is a spiral line with an equal spiral angle; and the fourth line segment (DE) is a spiral line whose spiral angle gradually decreases from a connection point (D) between the third line segment ($P_0D$) and the fourth line segment (DE) to a connection point (E) between the fourth line segment (DE) and the fifth line segment (EF).

2. The parallel double fan system of claim 1, wherein an impeller (22) is disposed inside the volute (21), and the following coordinate system of the first profile line (L1) is established: an intersection point that an axis of the impeller (22) passing through the plane of the first profile line (L1) is defined as an origin of coordinates (O), horizontal coordinate axis is defined as an X-axis, and vertical coordinate axis is defined as a Y-axis;

the first line segment ($AP_3$) and the sixth line segment (FG) are located in a first quadrant of the coordinate system; and the first line segment ($AP_3$) is a straight line segment parallel to the Y-axis.

3. The parallel double fan system of claim 2, wherein the sixth line segment (FG) is a straight line segment parallel to the Y-axis.

4. The parallel double fan system of claim 3, wherein the fifth line segment (EF) is connected between the fourth line segment (DE) and the sixth line segment (FG), X-coordinates of the fourth line segment (DE) are less than X-coordinates of the sixth line segment (FG);

an ending point of the fifth line segment (EF) corresponds to an intersection point of a position of the annular wall (213) near the rear cover (212) and the first air outlet (217); and the first air outlet (217) extends from the intersection point of the position of the annular wall and the first air outlet to the starting point and the ending point of the first profile line (L1).

5. The parallel double fan system of claim 4, wherein the fifth line segment (EF) is a Bezier curve.

6. The parallel double fan system of claim 1, wherein an impeller (22) is disposed inside the volute (21);

an intersection of the annular wall (213) and the front cover (211) is defined as a second profile line (L2) of the volute (21), the second profile line (L2) comprises a first line segment ($AP_3$), a third line segment ($P_0D$), a fourth line segment (DE), a fifth line segment (EF) and a sixth line segment (FG) that are corresponding to those of the first profile line (L1);

a seventh line segment ($P_3P_0'$) and an eighth line segment ($P_0'P_0$) are connected between the first line segment ($AP_3$) and the third line segment ($P_0D$) in turn;

the ending point of the second line segment ($P_3P_0$) in the first profile line (L1) corresponds to an ending point of the eighth line segment ($P_0'P_0$) in the second profile line (L2), and an ending point of the seventh line segment ($P_3P_0'$) corresponds to an ending point of the volute tongue (214) in the second profile line (L2).

7. The parallel double fan system of claim 6, wherein the annular wall (213) comprises a first air outlet sidewall (2133), an annular wall main portion (2134), a transition wall (2135), a second air outlet sidewall (2136) and an extension wall (2137);

profile line of the first air outlet sidewall (2133) corresponds to the first line segment ($AP_3$);

profile line at a side of the annular wall main portion (2134) intersected with the rear cover (212) corresponds to the third line segment ($P_0D$) and the fourth line segment (DE);

profile line at a side of the annular wall main portion (2134) intersected with the front cover (211) corresponds to the eighth line segment ($P_0'P_0$), the third line segment ($P_0D$) and the fourth line segment (DE);

profile line of the transition wall (2135) corresponds to the fifth line segment (EF);

profile line of the second air outlet sidewall (2136) corresponds to the sixth line segment (FG);

the extension wall (2137) and the volute tongue (214) are connected between the first air outlet sidewall (2133) and the annular wall main portion (2134), profile line at a side of the extension wall (2137) and the volute tongue (214) intersected with the rear cover (212) is the second line segment ($P_3P_0$), and profile line at a side of the extension wall (2137) and the volute tongue (214) intersected with the front cover (211) is the seventh line segment ($P_3P_0'$), so that the volute tongue (214) and the extension wall (2137) are an inclined flow guide curved surface on a side facing the volute (21) as a whole.

8. The parallel double fan system of claim 6, wherein the second line segment ($P_3P_0$) of the first profile line (L1) is a Bezier curve, and the line segment formed by the seventh line segment ($P_3P_0'$) and the eighth line segment ($P_0'P_0$) of the second profile line (L2) is also a Bezier curve.

9. A range hood equipped with the parallel double fan system of claim 1, comprising:

a housing (1) and the parallel double fan system disposed inside the housing (1);

wherein the front cover (211) is located below the rear cover (212), and the air inlet (215) faces downward and the first air outlet (217) faces upward.

10. The range hood of claim 9, wherein the annular wall (213) has a first end (2131) and a second end (2132);

the starting point of the first line segment ($AP_3$) is located at the first end (2131) of the annular wall (213), and the ending point of the sixth line segment (FG) is located at the second end (2132) of the annular wall (213);

the first end (2131) and the second end (2132) of the annular wall (213), the front cover (211) and the rear cover (212) form a second air outlet (216); and the first air outlet (217) and the second air outlet (216) selectively communicates the parallel double fan system with the outside.

11. The range hood of claim 9, wherein a flow guide device (4) for guiding the air flow to the first air outlet (217) is disposed at the second air outlet (216).

* * * * *